US006135203A

United States Patent [19]

McAnally

[11] Patent Number: 6,135,203

[45] Date of Patent: Oct. 24, 2000

[54] DOWNHOLE RECIPROCATING PLUNGER WELL PUMP

[76] Inventor: Charles W. McAnally, Harvard Station, Sproul Rd., Fort Davis, Tex. 79734

[21] Appl. No.: 09/065,202

[22] Filed: Apr. 23, 1998

[51] Int. Cl.[7] ..... F04B 47/12

[52] U.S. Cl. ..... 166/105.2; 166/105.4

[58] Field of Search ..... 166/68, 68.5, 105.1, 166/105.2, 105.3, 105.4

[56] References Cited

U.S. PATENT DOCUMENTS

| | | | |
|---|---|---|---|
| 1,636,433 | 7/1927 | Penrod et al. | 166/105.4 |
| 2,062,058 | 11/1936 | Howe | 103/221 |
| 2,074,591 | 3/1937 | Rood | 166/105.4 |
| 2,580,660 | 1/1952 | Crabtree | 166/105.4 |
| 2,641,197 | 6/1953 | Stone | 166/105.4 |
| 4,744,334 | 5/1988 | McAnally | 119/78 |
| 4,951,701 | 8/1990 | Boehmer | 137/199 |
| 5,207,726 | 5/1993 | Rathweg | 417/393 |
| 5,336,061 | 8/1994 | Armstrong | 417/411 |
| 5,699,858 | 12/1997 | McAnally | 166/382 |

*Primary Examiner*—William Neuder

*Attorney, Agent, or Firm*—Akin, Gump, Strauss, Hauer & Feld, L.L.P.

[57] ABSTRACT

A downhole reciprocating plunger pump includes an elongated tubular cylinder member which may be made of high-density polyethylene. A bottom inlet valve cage member is threadedly connected to the lower end of the cylinder and includes a reduced diameter portion which, together with the cylinder, forms an annular trash collection space. The pump plunger is connected to an elongated tubular plunger rod which is connected to the pump rod string extending within the well and receive working fluid discharged from the pump chamber through the plunger rod for discharge through ports in the rod into the interior of the cylinder and a tubing string connected to the pump. An elongated sleeve is detachably connected to the upper end of the plunger and forms an annular trash collection chamber with the plunger rod. Detachable valve seats connected to the bottom cage and the plunger, as well as the bottom cage and the plunger, may be formed of thermoplastic.

19 Claims, 3 Drawing Sheets

DOWNHOLE RECIPROCATING PLUNGER WELL PUMP

FIELD OF THE INVENTION

The present invention pertains to a downhole reciprocating plunger well pump.

BACKGROUND

Various designs of reciprocating plunger well pumps have been developed of the general type wherein the pump is mounted at the lower distal end of an elongated well tubing string, includes a reciprocating plunger or piston connected to an elongated rod extending to an actuating mechanism at the earth's surface and also includes a cylinder in which the plunger reciprocates to displace fluid from a plunger cavity and controlled by cavity inlet and discharge valves mounted on the cylinder and on the plunger, respectively.

In spite of the relatively highly developed state of the art in reciprocating plunger well pumps, certain problems in the operation of these pumps persist. In particular, conventional reciprocating plunger well pumps used in water wells, for example, are often burdened with rapid corrosion, in spite of the development of relatively corrosion resistant materials, and are prone to early failure or unexpected wear as a consequence of entrainment of solid particulates in the pumped fluid and the formation of wear-causing solids particles resulting from the above-mentioned corrosive operating conditions of such pumps.

Efforts to eliminate the above-mentioned problems while providing a well pump which is inexpensive to manufacture and is reliable in operation have not been entirely successful and further improvements in such pumps have long been sought. It is to these ends that the present invention has been developed.

SUMMARY OF THE INVENTION

The present invention provides an improved, downhole, reciprocating plunger well pump, particularly useful for water pumping applications.

In accordance with one aspect of the present invention, an improved reciprocating plunger well pump is provided which comprises an elongated cylinder which may be fabricated of a metal or plastic material and in cooperation with the other components of the pump, such as an inlet valve cage and seat, the plunger itself and the plunger or discharge valve seat provides a corrosion resistant pump which is also resistant to early failure when pumping fluids contaminated with solids particulates.

In accordance with another aspect of the invention, an improved reciprocating plunger well pump is provided with a trash or solids particulates retention space within the pumped fluid cylinder chamber or cavity, which space collects solids particulates and other "trash" to avoid having such particulates interfere with operation of the pump, become lodged between the plunger and the cylinder wall or become lodged between the discharge valve and its valve seat.

In accordance with a further aspect of the invention, a reciprocating plunger well pump is provided with a second trash collection or catcher space associated with the pump plunger and disposed thereabove and defined by an elongated sleeve which reciprocates with the plunger and eliminates the constant stirring and circulation of solids particulates within the pump cylinder in the area of the cylinder wall traversed by the pump plunger during operation of the pump.

The present invention still further provides an improved downhole reciprocating plunger pump which is inexpensive to manufacture and more reliable in operation, particularly in applications wherein corrosive or contaminant laden well fluids are being pumped.

Those skilled in the art will further appreciate the above mentioned advantages and superior features of the invention together with other important aspects thereof upon reading the detailed description which follows in conjunction with the drawing.

DETAILED DESCRIPTION OF A PREFERRED EMBODIMENT

Figure 1:
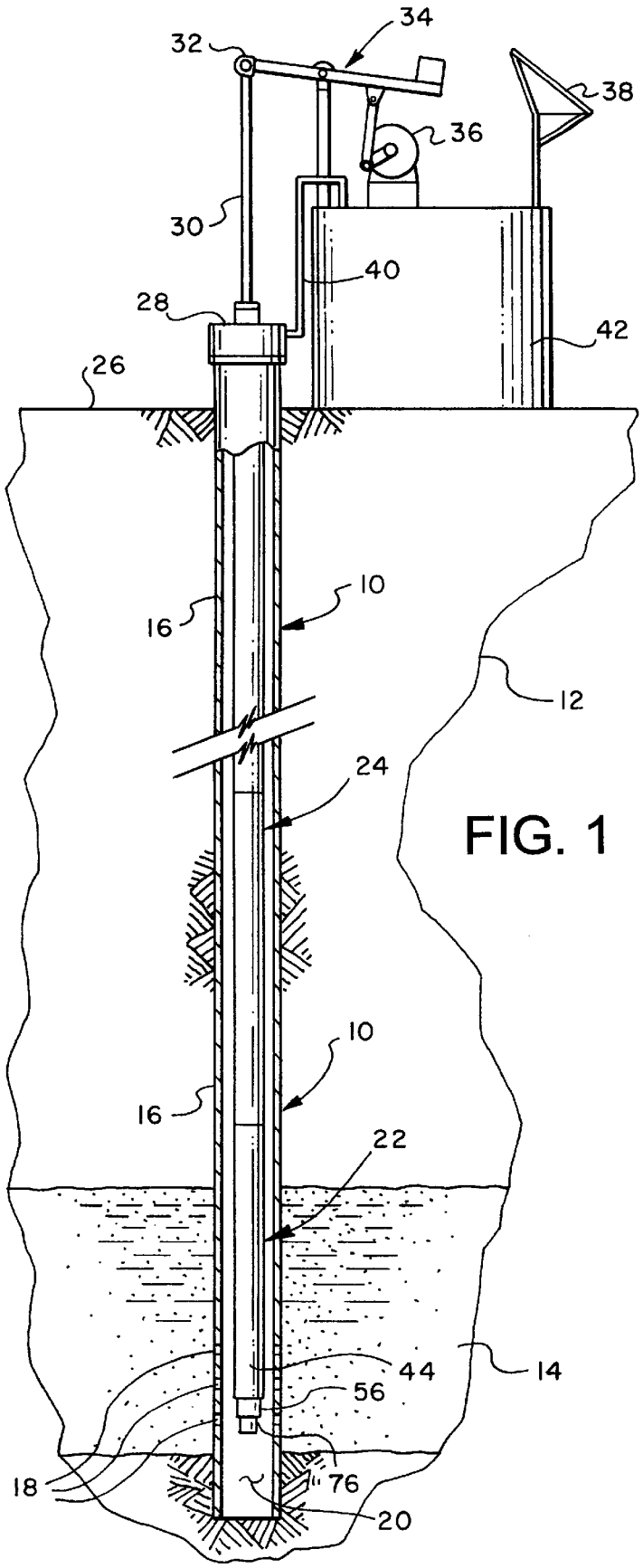
FIG. 1 is a vertical section view of a well in which the plunger pump of the invention is disposed and connected to a pump actuating mechanism on the earth's surface.

In the description which follows, like parts are marked throughout the specification and drawing with the same reference numerals, respectively. The drawing figures are not necessarily to scale and certain features may be shown in generalized or schematic form in the interest of clarity and conciseness.

Referring to FIG. 1, there is illustrated a vertical section view of a well 10 penetrating an earth formation 12 into a fluid bearing zone 14. The well 10 includes an elongated cylindrical casing 16 which is perforated at 18 in the zone 14 to allow formation fluid, such as water, to enter a wellbore 20.

A reciprocating plunger pump assembly 22 is disposed in the wellbore 20 and is connected to an elongated tubing string 24 extending from the pump 22 to the earth's surface 26 at which a suitable wellhead 28 is provided and is connected to the tubing string 24 in a conventional manner. The pump 22 is connected to an elongated reciprocating pump rod 30 which extends through the wellhead 28 and the tubing string 24 in a conventional manner and is also connected at its upper end 32 to a pump actuating mechanism, generally designated by the numeral 34. The pump actuating mechanism 34 is suitably connected to a drive motor 36 which may be energized by electricity from a source such as a photovoltaic panel 38. The actuating mechanism 34, motor 36 and panel 38 may be similar to that described in my U.S. Pat. No. 5,699,858 issued Dec. 23, 1997. Fluid pumped by the pump 22 up through the tubing string 24 may be conducted by way of a suitable conduit 40 connected to the wellhead 28 and to a storage tank 42. The above described pump installation shown in FIG. 1 is exemplary of an application of the improved downhole reciprocating plunger pump 22 of the present invention.

Figure 2:
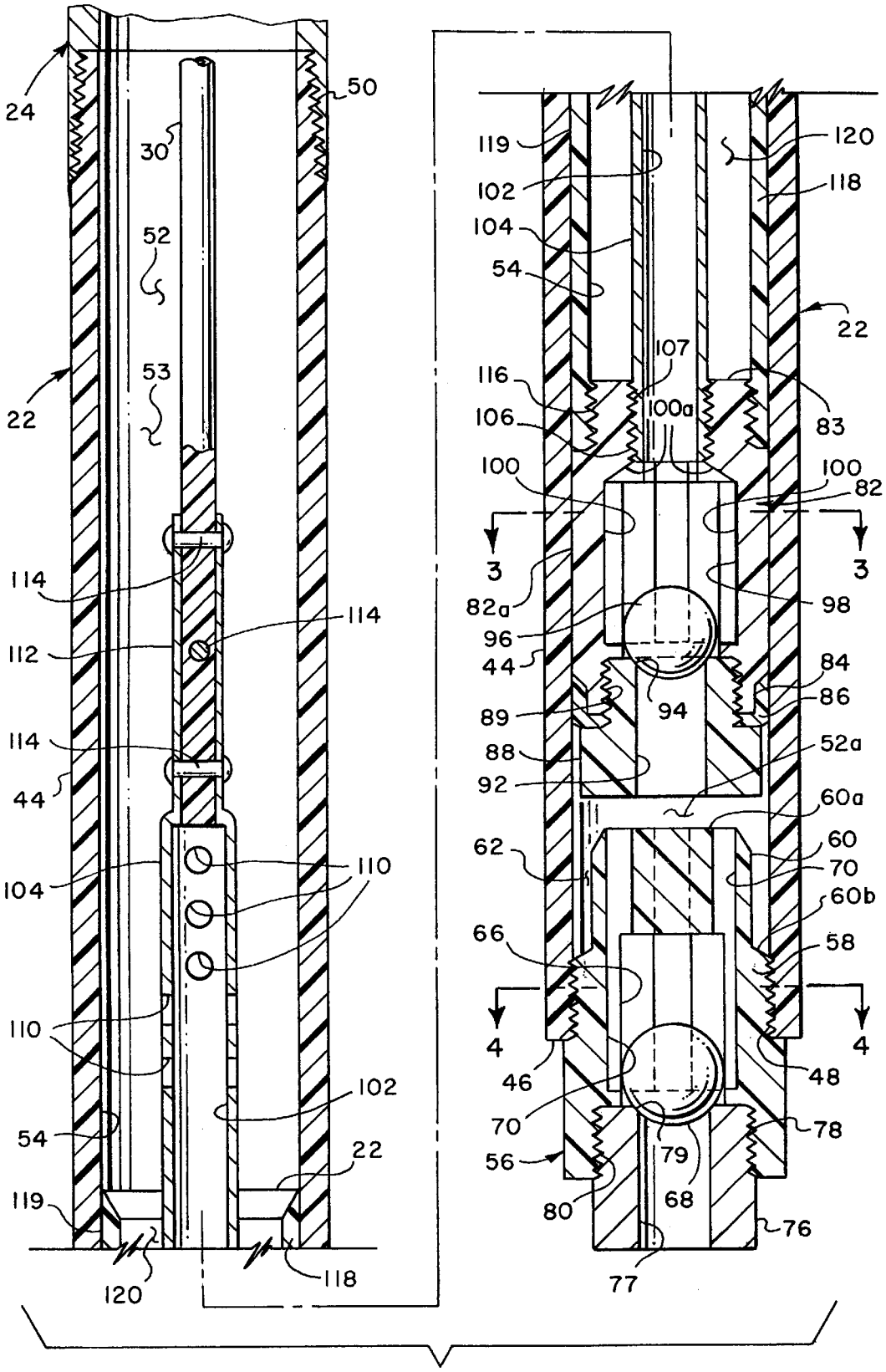
FIG. 2 is a longitudinal central section view through the pump shown in FIG. 1.
Figure 3:
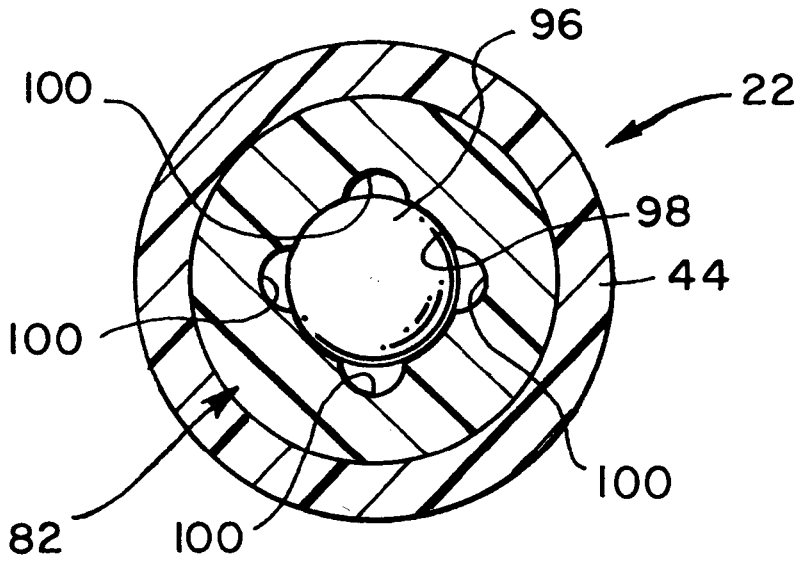
FIG. 3 is a section view taken along the line 3—3 of FIG. 2.
Figure 4:
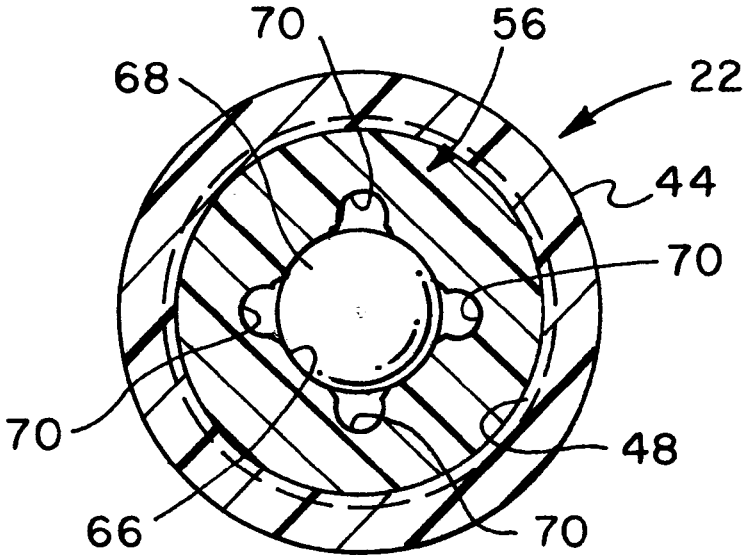
FIG. 4 is a section view taken along the line 4—4 of FIG. 2.

Referring now to FIGS. 2, 3 and 4, and primarily FIG. 2, the pump 22 includes an elongated cylinder member 44 having a lower distal end 46 which is internally threaded at 48 and an upper end which is externally threaded at 50. The cylinder 44 defines an internal bore 52 delimited by a cylinder wall 54. The wall 54 is typically machined or otherwise formed to be substantially smooth and have a somewhat polished finish thereto. In one embodiment of the pump 22, the cylinder 44 may be fabricated of a suitable corrosion resistant metal, such as stainless steel or brass. However, the invention also contemplates that the cylinder 44 may be fabricated of high density polyethylene. A typical downhole water well pump will have a diameter of the cylinder bore 52 of between about 1.75 inches and 2.75 inches and an overall cylinder length of about 4.0 feet.

The pump 22 is provided with a lower, generally cylindrical cage member 56 which includes a slightly reduced diameter portion 58 which is externally threaded and is threadedly engaged with the threads 48. The cage member 56 also includes a further reduced diameter portion 60 extending within the cylinder bore 52 and providing an elongated annular collection chamber 62 between a transverse end face 60*a* and a shoulder 60*b* of the cage 56 for collecting solids particulates and other debris which enters a pumping chamber 52*a* of cylinder bore 52 in a manner to be described further herein. For a cylinder 44 having bore dimensions mentioned above, the width of the annular chamber 62 is preferably about 0.38 inches and the length is about 1.20 inches.

The bottom cage member 56 includes a central bore 66, see FIG. 4 also, for receiving a valve closure ball 68 therein for movement between the position shown and a position upwardly in the bore 66 so that working fluid may pass through circumferentially spaced passages 70, longitudinally extending through the cage member 56, including the reduced diameter portion 60, so that working fluid may enter the cylinder chamber 52*a*. The ball closure member 68 is retained in the cage 56 by a removable seat member 76 comprising a generally cylindrical plug having an externally threaded portion 78 which is engageable with a threaded bore portion 80 of the cage member 56 for retaining the closure member 68 within the bore 66. The seat member 76 includes a central fluid inlet passage 77 and a transverse frustoconical seat surface 79 for engagement with the ball closure member 68 to prevent flow of fluid from the bore 52 out of the pump through the passages 70 and 66.

Referring further to FIGS. 2 and 3, the pump 22 also includes a reciprocating, cylindrical plunger 82 having a reduced diameter lower end 84 for receiving an annular, cup shaped seal member 86 which may be formed of a suitable resilient material and is retained in assembly with the plunger 82 by a generally cylindrical seat member 88. The seat member 88 is threadedly engaged with the plunger 82 at an internally threaded bore portion 89 of the plunger. The seat member 88 has a central passage 92 formed therein opening to the chamber 52*a* and a generally frustoconical transverse seat surface 94 for engagement with a second ball type valve closure member 96. Closure member 96 is disposed in a bore 98 formed in the plunger 82, which bore is intersected by four circumferentially spaced and longitudinally extending passages 100, see FIG. 3, which allow fluid to flow through passage 92, past the closure member 96, when unseated from the seat 94, and into a passage 102 formed in a tubular plunger rod 104. Passage portions 100*a*, FIG. 2, provide for fluid flow to passage 102 even if closure member 96 is moved upward in bore 98 to a limit position. Plunger rod 104 is preferably threadedly engaged with the plunger 82 at the lower end 106 of the rod which end is disposed in a threaded bore 107 formed in the upper end of the plunger 82, as shown, and opening into the bore 98.

The opposite end of the plunger rod 102 includes plural spaced apart passages or ports 110 for conducting pumped fluid into the bore 52 above the plunger 82, which portion of the bore 52 forms a passage 53 which is in communication with the conduit or tubing string 24 for pumping fluid to the earth's surface. The tubular rod 104 includes a reduced diameter portion 112 which is suitably connected to the pump rod 30 at the lower end thereof by suitable fasteners 114, as shown.

Referring further to FIG. 2, the plunger 82 is uniquely adapted at its upper end 83 to include a reduced diameter portion 116 which is externally threaded and is adapted to be connected to an elongated tubular sleeve 118 extending upward from the plunger 82, forming a part thereof and defining with the rod 104 an elongated annular cavity 120. The sleeve 118 is open at its upper end 122 to the cylinder bore passage 53 and forms a collection cavity or chamber defined by the annular space 120 for collecting solids particulates and other debris which may work its way through the pump 22 with the pumped fluid. The outer cylindrical surface 119 of the sleeve 118 is dimensioned to be in close fitting sleeved relationship within the cylinder 44 and nominally is dimensioned to provide a diametral clearance of between 0.001 and 0.003 inches with respect to the bore of the cylinder 44. The outer cylindrical wall surface 82*a* of the plunger 82 is dimensioned to provide the same diametral clearance in regard to the cylinder wall 54.

The operation of the pump 22 is believed to be readily understandable to those of skill in the art from the foregoing description. However, briefly, when the plunger 82 is moved upwardly, viewing FIG. 2, by the rod 30 and the pump rod 104, fluid is drawn into the bore 52 by effecting unseating of the valve closure member 68 from the seat surface 79 whereupon fluid will flow through passage 77, bore 66 and passages 70 into the chamber 55 formed between the plunger 82 and the cage 56. As the plunger 82 moves upwardly and fluid enters the chamber 52*a*, solids particulates entrained in the working fluid will tend to settle out into the annular space 62 and not be further entrained with the working fluid when the plunger reverses direction and moves downwardly in the cylinder 44 to displace fluid from the chamber 52*a*.

During a downstroke of the plunger 82, fluid disposed in the chamber 52*a* is trapped from flow back through the cage 56 and the seat 76 by movement of the closure member 68 into engagement with the seat surface 79. However, the downward movement of the plunger 82 will unseat the closure member 96 from seat 94 allowing fluid to flow through the passages 100 and the bore 98 into the passage 102 and fluid will also be displaced through the passage 102 and the ports 110 into the cylinder passage 53 above the plunger. Again, solids particulates entrained in the working fluid will tend to settle out into the annular space 120 to thus not interfere with operation of the pump 22 during either an upstroke or downstroke of the plunger. It is contemplated that the pump 22 may be operated for an extended period of time before a sufficient amount of solids particulates collect in the spaces 62 or 120 to the extent that these spaces are filled with particulate material. Accordingly, the operation and reliability of the pump 22 is enhanced as compared with prior art reciprocating plunger pumps.

The fabrication of the pump 22 is also believed to be within the purview of one of ordinary skill in the art. The materials used for the seat member 76 and the bottom cage 56 may be a suitable thermoplastic, such as Nylon. In like manner, the seat member 88, the plunger 82 and the sleeve 118 may also be formed of Nylon. The closure members 68 and 96 may be formed of corrosion resistant metal or plastic, such as Nylon. The plunger rod 104 is preferably formed of stainless steel or brass. The rod string 30 may be formed of metal or reinforced plastic. As noted above, the resilient annular cup seal 86 may be advantageous for use with pumps wherein the cylinder 44 is formed of metal and the other components are formed of the materials mentioned herein above. However, if the cylinder 44 is formed of a thermoplastic, such as Nylon or high-density polyethylene, the annular cup seal 86 may be eliminated since differential thermal expansion characteristics between the plunger 82 and the cylinder 44 will be reduced.

Although a preferred embodiment of the invention has been described in detail herein above, those skilled in the art will recognize that various substitutions and modifications may be made without departing from the scope and spirit of the invention as recited in the appended claims.

What is claimed is:

1. A downhole reciprocating plunger well pump comprising:

an elongated tubular cylinder member including an internal bore defined by a cylinder wall and means for connecting said cylinder member to a well tubing string;

a cylindrical pump plunger disposed in said cylinder member for reciprocation therein;

an elongated tubular plunger rod connected at one end to said plunger and at another end to an elongated rod string for reciprocating said plunger in said cylinder member; and a bottom cage member releasably connected to a lower distal end of said cylinder member, and stationary with respect to said cylinder member, said cage member including passage means therein for conducting working fluid into a pump chamber defined by said cylinder member between said bottom cage member and said plunger, said bottom cage member and said cylinder being configured to define a stationary annular space therebetween for collecting debris entrained with working fluid entering said pump chamber.

2. The pump set forth in claim 1 including:

an elongated sleeve connected to said plunger and extending in sleeved relationship around said plunger rod and defining an annular space for collection of debris separated from working fluid entering said cylinder bore between said tubing string and said plunger.

3. The pump set forth in claim 2 wherein:

said plunger rod includes an elongated passage extending therewithin for conducting fluid from said pump chamber and port means in communication with said passage in said plunger rod for conducting pumped fluid into a bore portion of said cylinder adjacent to said sleeve.

4. The pump set forth in claim 1 wherein:

said bottom cage member includes a bore portion for receiving a closure member therein and a bore portion for receiving a removable seat member for engagement with said closure member to prevent discharge of working fluid from said pump chamber through said bottom cage member into a wellbore.

5. The pump set forth in claim 1 wherein:

said plunger includes an internal bore for receiving a closure member and a removable seat member engaged with said plunger for retaining said closure member in said bore in said plunger and forming a seat surface for engagement with said closure member to prevent working fluid from flowing into said chamber from said passage in said plunger rod.

6. The pump set forth in claim 5 including:

a resilient annular seal member engageable with said cylinder wall and supported on said plunger between one end of said plunger and said plunger seat member.

7. The pump set forth in claim 1 wherein:

said cylinder member is formed of a thermoplastic.

8. The pump set forth in claim 7 wherein:

said cylinder member is formed of polyethylene.

9. The pump set forth in claim 1 wherein:

said bottom cage member and said plunger are formed of thermoplastic.

10. A downhole reciprocating plunger well pump comprising:

an elongated tubular cylinder member including an internal bore defined by a cylinder wall and means for connecting said cylinder member to a well tubing string;

a plunger disposed in said cylinder member for reciprocation therein;

an elongated tubular pump rod connected at one end to said plunger and at another end to an elongated rod string for reciprocating said plunger in said cylinder member; and an elongated sleeve connected to said plunger for reciprocation with said plunger and extending in sleeved relationship around said plunger rod and defining an annular space in said cylinder member for collection of debris separated from working fluid entering said cylinder member between said tubing string and said plunger.

11. The pump set forth in claim 10 wherein:

said plunger rod includes an elongated passage extending therewithin for conducting fluid from a pump chamber defined by said cylinder member and said plunger, and port means in communication with said passage in said plunger rod for conducting pumped fluid into a bore portion of said cylinder member adjacent to said sleeve.

12. The pump set forth in claim 11 wherein:

said plunger includes an internal bore for receiving a closure member and a removable seat member engaged with said plunger for retaining said closure member in said bore in said plunger and forming a seat surface for engagement with said closure member to prevent working fluid from flowing into said pump chamber from said passage in said plunger rod.

13. The pump set forth in claim 10 including:

a bottom cage member releasably connected to a lower distal end of said cylinder member, said bottom cage member including passage means therein for conducting working fluid into said pump chamber between said bottom cage member and said plunger, said bottom cage member and said cylinder member being configured to define an annular space therebetween for collecting debris entrained with working fluid entering said pump chamber.

14. The pump set forth in claim 13 wherein:

said bottom cage member includes a bore portion for receiving a closure member therein and a bore portion for receiving a removable seat member for engagement with said closure member in said bore portion to prevent discharge of working fluid from said pump chamber through said bottom cage member into a wellbore.

15. The pump set forth in claim 10 wherein:

said cylinder member is formed of a thermoplastic.

16. The pump set forth in claim 15 wherein:

said cylinder member is formed of polyethylene.

17. A downhole reciprocating plunger well pump comprising:

an elongated tubular cylinder member including an internal bore defined by a cylinder wall and means for connecting said cylinder member to a well tubing string for conducting working fluid from said pump through said tubing string;

a cylindrical pump plunger disposed in said cylinder member for reciprocation therein;

an elongated tubular plunger rod connected at one end to said plunger and at another end to a rod string for reciprocating said plunger in said cylinder member;

a bottom cage member releasably connected to a lower distal end of said cylinder member, said bottom cage member including passage means therein for conducting working fluid into a pump chamber defined by said cylinder member between said bottom cage member and said plunger, said bottom cage member including a reduced diameter portion extending within said cylinder member and defining an annular space between a transverse end of said bottom cage member and a shoulder formed on said bottom cage member and said cylinder wall for collecting debris entrained with working fluid entering said pump chamber; and an elongated sleeve connected to said plunger for reciprocation with said plunger and extending in sleeved relationship around said plunger rod and defining an annular space for collection of debris separated from working fluid entering said cylinder bore between said tubing string and said plunger.

18. The pump set forth in claim 17 wherein:

said plunger rod includes an elongated passage extending therewithin for conducting fluid from said pump chamber, and port means in communication with said passage in said plunger for conducting pumped fluid into a bore portion of said cylinder member adjacent to said sleeve.

19. The pump set forth in claim 17 wherein:

said cylinder member is formed of a polyethylene tube, and said plunger, said bottom cage member and said sleeve are formed of a thermoplastic selected from a group consisting of Nylon and polyethylene.

* * * * *